US011898447B2

(12) United States Patent
Dai et al.

(10) Patent No.: US 11,898,447 B2
(45) Date of Patent: Feb. 13, 2024

(54) FULL-CIRCLE SECONDARY LINING INVERTED ARCH CONSTRUCTION FORMWORK SYSTEM FOR LONG-DISTANCE TUNNEL AND FORMWORK TRANSPORTING METHOD

(71) Applicants: CCTEB INFRASTRUCTURE CONSTRUCTION INVESTMENT CO., LTD., Hubei (CN); CHINA CONSTRUCTION THIRD ENGINEERING BUREAU GROUP CO;LTD, Hubei (CN)

(72) Inventors: Xiaosong Dai, Hubei (CN); Kaiyang Liu, Hubei (CN); Ruihua Jia, Hubei (CN); Changyi Su, Hubei (CN); Haihua Gu, Hubei (CN); Yisheng Ye, Hubei (CN); Wei Chen, Hubei (CN); Xiaofei Xie, Hubei (CN); Hao Zhou, Hubei (CN); Jian Cui, Hubei (CN); Yisheng Luo, Hubei (CN); Wenbo Lu, Hubei (CN)

(73) Assignees: CCTEB INFRASTRUCTURE CONSTRUCTION INVESTMENT CO., LTD., Hubei (CN); CHINA CONSTRUCTION THIRD ENGINEERING BUREAU GROUPCO;LTD, Hubei (CN)

( * ) Notice: Subject to any disclaimer, the term of this patent is extended or adjusted under 35 U.S.C. 154(b) by 478 days.

(21) Appl. No.: 17/228,686

(22) Filed: Apr. 12, 2021

(65) Prior Publication Data

US 2021/0231014 A1 Jul. 29, 2021

Related U.S. Application Data

(63) Continuation of application No. PCT/CN2021/081400, filed on Mar. 18, 2021.

(51) Int. Cl.
*E21D 11/10* (2006.01)
*E21D 11/40* (2006.01)

(52) U.S. Cl.
CPC ..... *E21D 11/102* (2013.01); *E21D 11/40* (2013.01)

(58) Field of Classification Search
CPC ..... E21D 11/102; E21D 11/40; E21D 11/10
See application file for complete search history.

(56) References Cited

U.S. PATENT DOCUMENTS 4,452,549 A * 6/1984 Hart ..... E21D 11/08 405/150.1

FOREIGN PATENT DOCUMENTS

CN 103352710 A * 10/2013
CN 206016831 U * 3/2017
(Continued)

*Primary Examiner* — Michael Safavi

(57) ABSTRACT

A full-circle secondary lining inverted arch construction formwork system for a long-distance tunnel and a formwork transporting method adopt a customized steel formwork, a steel pipe support, and a turn buckle. The steel pipe support is arranged on the longitudinal main edge, and is provided between the longitudinal rails and a primary lining for supporting vertical buoyancy. The turn buckle is arranged between two sides of the formwork and a reserved steel bar for resisting horizontal load generated during asymmetric pouring. A cantilever gantry crane and a transportation flat car are used for formwork transporting, wherein travel rails of the cantilever gantry crane and the transportation flat car are integrated on the customized steel formwork, and there is no other rail. According to the present, the formwork has high strength and rigidity, the formwork system is simple.

2 Claims, 3 Drawing Sheets

(56) References Cited

FOREIGN PATENT DOCUMENTS

| | | | | | |
|---|---|---|---|---|---|
| CN | 206707736 | U | * | 12/2017 | |
| CN | 207634090 | U | * | 7/2018 | |
| CN | 111140254 | A | * | 5/2020 | ..... E21D 11/102 |
| JP | 2001173386 | A | * | 6/2001 | |
| JP | 2003232196 | A | * | 8/2003 | |

* cited by examiner

FULL-CIRCLE SECONDARY LINING INVERTED ARCH CONSTRUCTION FORMWORK SYSTEM FOR LONG-DISTANCE TUNNEL AND FORMWORK TRANSPORTING METHOD

CROSS REFERENCE OF RELATED APPLICATION

The application is a continuation application of a PCT application No. PCT/CN2021/081400, filed on Mar. 18, 2021.

BACKGROUND OF THE PRESENT INVENTION

Field of Invention

The present invention relates to a technical field of tunnel construction, and more particularly to a full-circle secondary lining inverted arch construction formwork system for a long-distance tunnel and a formwork transporting method.

Description of Related Arts

Along with the needs of social development and the progress of construction technology, long-distance full-circle tunnels are increasing. During secondary lining inverted arch construction of the long-distance full-circle tunnel, a small formwork splicing mode is adopted, leading to a complicated formwork system. As a result, the workload of formwork transport is high, the personnel investment is large, the quality is difficult to control, and the roundness is poor. An inverted arch trolley is adopted for construction, wherein the single construction length is limited and the equipment cost is high, which are not conducive to large investment.

SUMMARY OF THE PRESENT INVENTION

In order to overcome technical defects in the prior art such as high transporting workload, large personnel investment, and difficult quality control during secondary lining inverted arch construction of a long-distance full-circle tunnel, the present invention provides a full-circle secondary lining inverted arch construction formwork system for a long-distance tunnel and a formwork transporting method.

Accordingly, in order to accomplish the above objects, the present invention provides a full-circle secondary lining inverted arch construction formwork system for a long-distance tunnel, comprising: a customized steel formwork, a steel pipe support, and a turn buckle. The steel pipe support is arranged on the longitudinal main edge, and is provided between the longitudinal rails and a primary lining for supporting vertical buoyancy. The turn buckle is arranged between two sides of the formwork and a reserved steel bar for resisting horizontal load generated during asymmetric pouring.

The customized steel formwork comprises a panel, a flange plate, a ring-shaped secondary edge, a longitudinal main edge, two longitudinal rails, an oblique supporting system, and a cover plate, wherein the flange plate, the ring-shaped secondary edge and the longitudinal main edge are welded on the panel to bear forces together; the longitudinal rails are arranged on the ring-shaped secondary edge, and end surfaces of the longitudinal rails are flush with the flange plate; a ring width of the panel is smaller than a clearance between the two longitudinal rails integrated on the customized steel formwork as well as a clearance between two columns of a cantilever gantry crane; the oblique supporting system comprises a fixed base plate, an adjustable pin cylinder, an oblique supporting rod, and a limiting pin shaft, wherein a through hole and an internal thread are arranged in a middle of the fixed base plate; the adjustable pin cylinder has a matched external thread and is screwed into the through hole of the fixed base plate; an extending length of the oblique supporting rod is adjusted through threads; the oblique supporting rod is a steel pipe; an end-blocking steel plate is provided on a bottom of the oblique supporting rod, and a pull ring is provided on a top of the oblique supporting rod; the adjustable pin cylinder has a limit hole, and the oblique supporting rod has two limit holes; before concrete pouring, the limit hole on the top of the oblique supporting rod is aligned with the limit hole of the adjustable pin cylinder, and is locked by the limiting pin shaft to support a formwork; after the concrete pouring, the limiting pin shaft is pulled out; then the limit hole on the bottom of the oblique supporting rod is aligned with the limit hole of the adjustable pin cylinder, and is locked by the limiting pin shaft to form a formwork surface; the cover plate is located on the ring-shaped secondary edge to prevent the formwork from being polluted by concrete during the concrete pouring;

The present invention also provides a formwork transporting method for full-circle secondary lining inverted arch construction of a long-distance tunnel, comprising adopting a cantilever gantry crane and a transportation flat car for formwork transporting, wherein travel rails of the cantilever gantry crane and the transportation flat car are integrated on a customized steel formwork, and there is no other rail; the formwork transporting method comprises specific steps of:

S1: installing the cantilever gantry crane at a hole entrance; hoisting the customized steel formwork by a cantilever part outside the hole, and rotating for 90 degrees;

S2: starting a longitudinally-moving hoist; moving a first formwork to pass through columns of the cantilever gantry crane, and transporting to a cantilever part in the hole; then rotating the first formwork by 90 degrees;

S3: lowering the first formwork by the cantilever part in the hole; meanwhile, extending an oblique supporting rod out of the first formwork for supporting, in such a manner that longitudinal rails integrated on the first formwork are aligned with the rails of the cantilever gantry crane;

S4: repeating the steps S1-S3, thereby installing a second formwork, and connecting flanges of the first formwork and the second formwork;

S5: repeating the steps S1-S4, thereby installing residual formworks; using the transportation flat car when the formworks are more than a certain amount, so as to improve efficiency;

S6: reinforcing the formworks with steel pipe supports and turn buckles, and pouring concrete; withdrawing the oblique supporting rod to a formwork surface as soon as concrete pouring is finished, and then curing;

S7: removing the steel pipe supports and the turn buckles, and installing a secondary cantilever gantry crane at the hole entrance;

S8: hoisting the first installed formwork by a cantilever part at the hole entrance, and rotating by 90 degrees; starting the longitudinally-moving hoist, moving the first installed formwork to pass through the columns of the cantilever gantry crane, and transporting to a cantilever part at the other end; then rotating the first installed formwork by 90 degrees and placing on the transporting flat car;

S9: moving the transportation flat car to the secondary cantilever gantry crane, hoisting the first installed formwork by a cantilever part at one end, and rotating by 90 degrees; starting the longitudinally-moving hoist; moving the first installed formwork to pass through the columns of the cantilever gantry crane, and transporting to a cantilever part at the other end; lowering the first installed formwork to finish transportation and installation; and S10: repeating the steps S8 and S9; transporting, installing, supporting and reinforcing the residual formworks, and pouring concrete.

In summary, compared with the prior art, the technical scheme of the present invention has the following beneficial effects:

1. According to the full-circle secondary lining inverted arch construction formwork system for the long-distance tunnel and the formwork transporting method of the present invention, the formwork has high strength and rigidity, the formwork system is simple, and mechanization degree is high. As a result, labor intensity can be reduced, labor investment is saved, and labor cost is reduced. The formworks are annularly integrated and has no longitudinal splicing seams. With annular flange connection, flatness is high, staggered platforms are avoided, and inverted arch forming quality is good.

2. According to the present invention, the formwork transporting method for the full-circle secondary lining inverted arch construction of the long-distance tunnel is simple to operate and high in working efficiency. As a result, efficiency of the full-circle secondary lining inverted arch construction of the long-distance tunnel can be improved, and the construction period can be saved.

BRIEF DESCRIPTION OF THE DRAWINGS

An embodiment of the present invention will be further illustrated in conjunction with the accompanying drawings, wherein.

Element reference: 1—customized steel formwork, 2—cantilever gantry crane, 3—transportation flat car, 4—poured inverted arch, 5—inverted arch to be poured, 6—primary lining, 7—steel pipe support, 8—turn buckle, 9—secondary lining steel bar, 101—panel, 102—flange plate, 103—longitudinal rail, 104—oblique supporting system, 105—cover plate.

DETAILED DESCRIPTION OF THE PREFERRED EMBODIMENT

Figure 1:
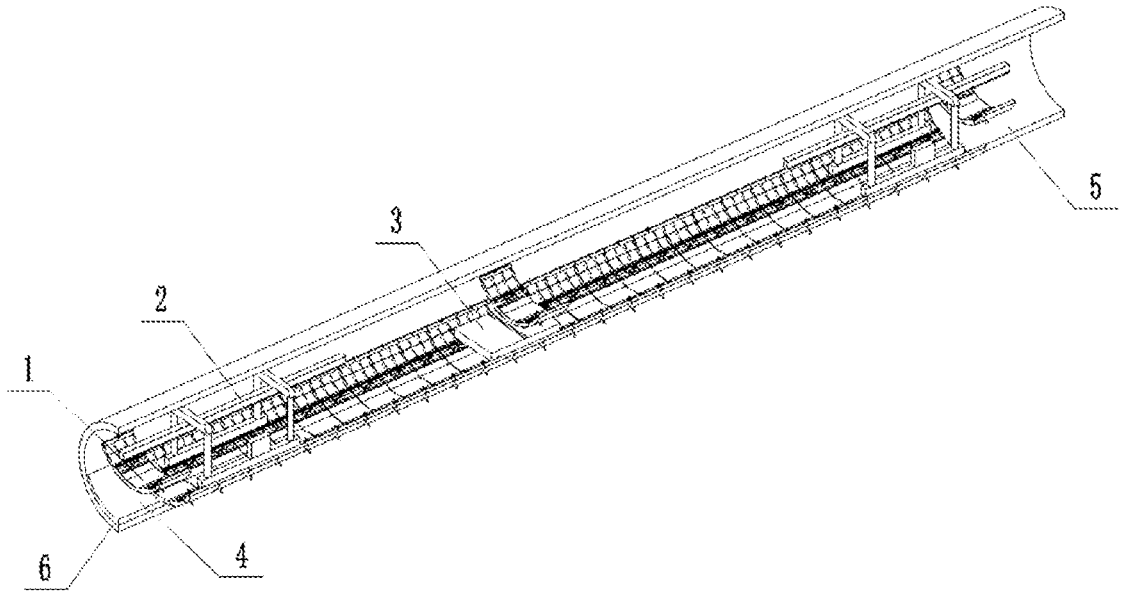
FIG. 1 is a perspective view of a full-circle secondary lining inverted arch construction formwork system for a long-distance tunnel of the present invention.
Figure 2:
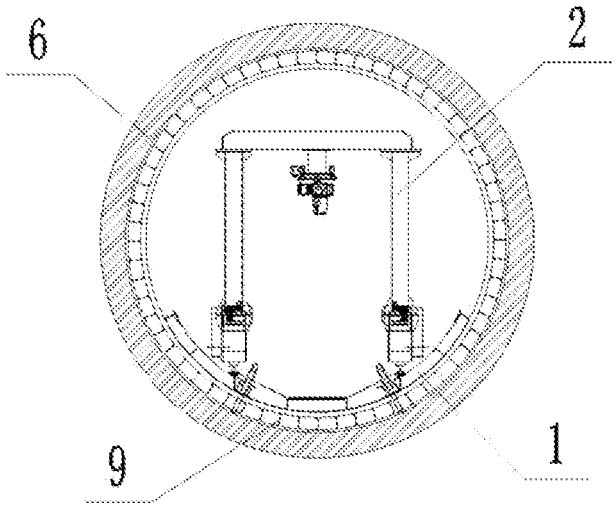
FIG. 2 is a cross-sectional view of FIG. 1.
Figure 3:
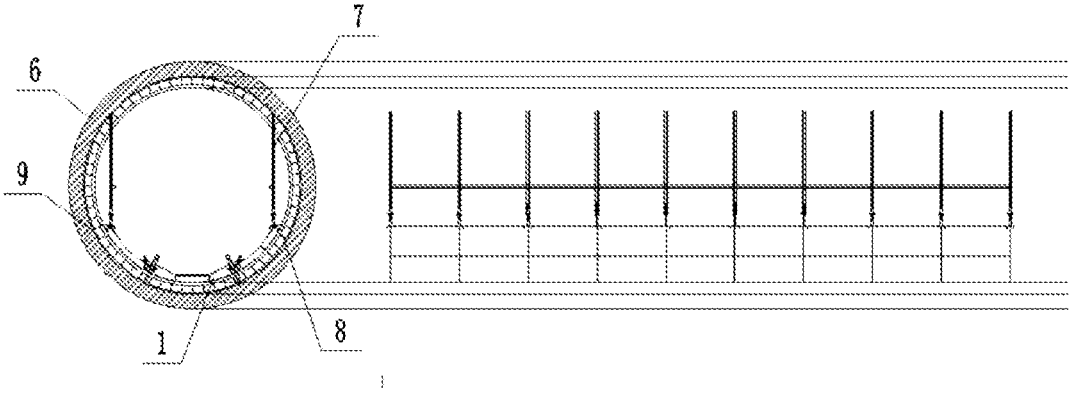
FIG. 3 is a sketch view of the formwork system of the present invention.

Referring to FIGS. 1-3 of the drawings, perspective view and cross-sectional view of a full-circle secondary lining inverted arch construction formwork system for a long-distance tunnel are illustrated. The formwork system comprises: a customized steel formwork 1, a steel pipe support 7, and a turn buckle 8, wherein the steel pipe support 7 is arranged on the longitudinal main edge, and is provided between the longitudinal rails 103 and a primary lining 6 for supporting vertical buoyancy; the turn buckle 8 is arranged between two sides of the formwork and a reserved steel bar for resisting horizontal load generated during asymmetric pouring.

Figure 4:
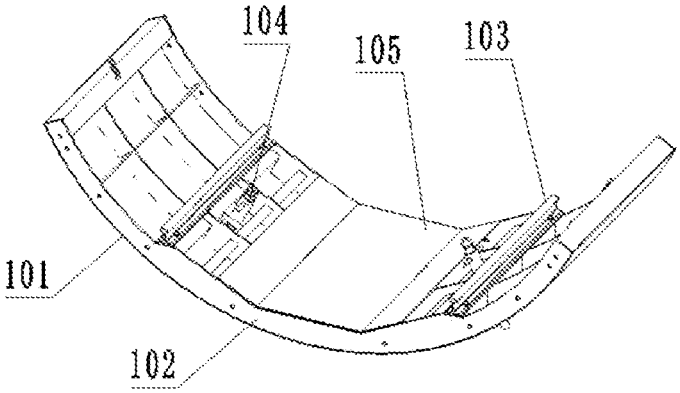
FIG. 4 is a structural view of a formwork of the present invention.

The customized steel formwork 1 comprises a panel 101, a flange plate 102, a ring-shaped secondary edge, a longitudinal main edge, two longitudinal rails 103, an oblique supporting system 104, and a cover plate 105. Referring to FIG. 4, the flange plate 102, the ring-shaped secondary edge and the longitudinal main edge are welded on the panel 101 to bear forces together; the longitudinal rails 103 are arranged on the ring-shaped secondary edge, and end surfaces of the longitudinal rails 103 are flush with the flange plate 102; a ring width of the panel 101 is smaller than a clearance between the two longitudinal rails 103 integrated on the customized steel formwork 1 as well as a clearance between two columns of a cantilever gantry crane 2. The cover plate 105 is located on the ring-shaped secondary edge to prevent the formwork from being polluted by concrete during the concrete pouring.

The oblique supporting system 104 comprises a fixed base plate, an adjustable pin cylinder, an oblique supporting rod, and a limiting pin shaft, wherein a through hole and an internal thread are arranged in a middle of the fixed base plate; the adjustable pin cylinder has a matched external thread and is screwed into the through hole of the fixed base plate; an extending length of the oblique supporting rod is adjusted through threads; the oblique supporting rod is a steel pipe; an end-blocking steel plate is provided on a bottom of the oblique supporting rod, and a pull ring is provided on a top of the oblique supporting rod; the adjustable pin cylinder has a limit hole, and the oblique supporting rod has two limit holes; before concrete pouring, the limit hole on the top of the oblique supporting rod is aligned with the limit hole of the adjustable pin cylinder, and is locked by the limiting pin shaft to support a formwork; after the concrete pouring, the limiting pin shaft is pulled out; then the limit hole on the bottom of the oblique supporting rod is aligned with the limit hole of the adjustable pin cylinder, and is locked by the limiting pin shaft to form a formwork surface.

Figure 5:
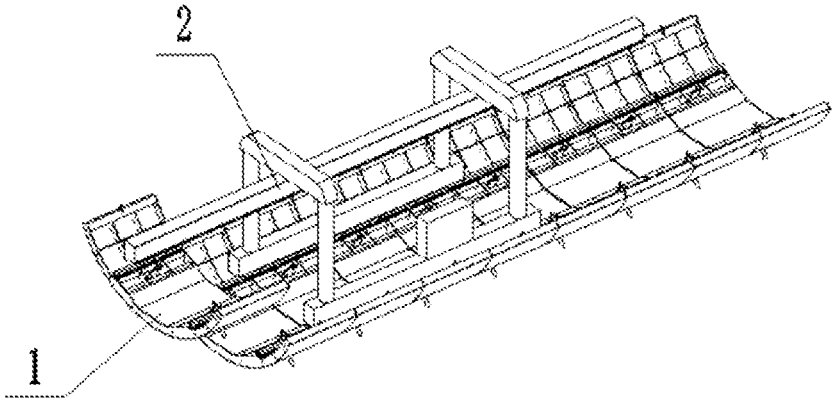
FIG. 5 is a sketch view of formwork transporting of the present invention.
Figure 6:
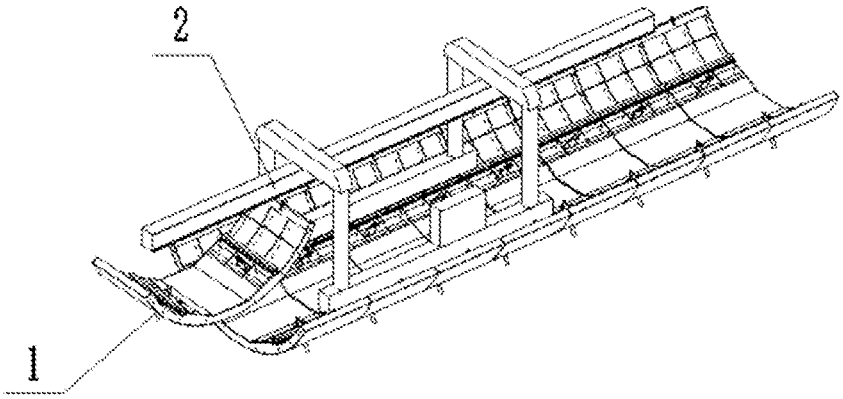
FIG. 6 is a sketch view of rotating the formwork of the present invention during transporting.

The present invention also provides a formwork transporting method for full-circle secondary lining inverted arch construction of a long-distance tunnel, comprising adopting a cantilever gantry crane 2 and a transportation flat car 3 for formwork transporting, wherein travel rails of the cantilever gantry crane 2 and the transportation flat car 3 are integrated on a customized steel formwork 1, and there is no other rail; the formwork transporting method comprises specific steps of:

S1: installing the cantilever gantry crane 2 at a hole entrance; hoisting the customized steel formwork 1 by a cantilever part outside the hole, and rotating for 90 degrees, as shown in FIGS. 5 and 6;

S2: starting a longitudinally-moving hoist; moving a first formwork to pass through columns of the cantilever gantry crane 2, and transporting to a cantilever part in the hole; then rotating the first formwork by 90 degrees;

S3: lowering the first formwork by the cantilever part in the hole; meanwhile, extending an oblique supporting rod out of the first formwork for supporting, in such a manner that longitudinal rails 103 integrated on the first formwork are aligned with the rails of the cantilever gantry crane 2;

S4: repeating the steps S1-S3, thereby installing a second formwork, and connecting flanges 105 of the first formwork and the second formwork;

S5: repeating the steps S1-S4, thereby installing residual formworks; using the transportation flat car 3 when the formworks are more than a certain amount, so as to improve efficiency;

S6: reinforcing the formworks with steel pipe supports 7 and turn buckles 8, and pouring concrete; withdrawing the oblique supporting rod to a formwork surface as soon as concrete pouring is finished, and then curing;

S7: removing the steel pipe supports 7 and the turn buckles 8, and installing a secondary cantilever gantry crane 2 at the hole entrance;

S8: hoisting the first installed formwork by a cantilever part at the hole entrance, and rotating by 90 degrees; starting the longitudinally-moving hoist, moving the first installed formwork to pass through the columns of the cantilever gantry crane 2, and transporting to a cantilever part at the other end; then rotating the first installed formwork by 90 degrees and placing on the transporting flat car 3;

S9: moving the transportation flat car 3 to the secondary cantilever gantry crane 2, hoisting the first installed formwork by a cantilever part at one end, and rotating by 90 degrees; starting the longitudinally-moving hoist; moving the first installed formwork to pass through the columns of the cantilever gantry crane 2, and transporting to a cantilever part at the other end; lowering the first installed formwork to finish transportation and installation; and S10: repeating the steps S8 and S9; transporting, installing, supporting and reinforcing the residual formworks, and pouring concrete.

It will be understood by those skilled in the art that the foregoing description is only one embodiment of the present invention, and is not intended to be limiting. Any modification, equivalent replacement, or improvement made within the spirit and principle of the present invention should be included in the protection scope

What is claimed is:

1. A full-circle secondary lining inverted arch construction formwork system for a long-distance tunnel, comprising: a customized steel formwork (1), a steel pipe support (7), and a turn buckle (8), wherein:

the customized steel formwork (1) comprises a panel (101), a flange plate (102), a ring-shaped secondary edge, a longitudinal main edge, two longitudinal rails (103), an oblique supporting system (104), and a cover plate (105), wherein the flange plate (102), the ring-shaped secondary edge and the longitudinal main edge are welded on the panel (101) to bear forces together; the longitudinal rails (103) are arranged on the ring-shaped secondary edge, and end surfaces of the longitudinal rails (103) are flush with the flange plate (102); a ring width of the panel (101) is smaller than a clearance between the two longitudinal rails (103) integrated on the customized steel formwork (1) as well as a clearance between two columns of a cantilever gantry crane (2); the oblique supporting system (104) comprises a fixed base plate, an adjustable pin cylinder, an oblique supporting rod, and a limiting pin shaft, wherein a through hole and an internal thread are arranged in a middle of the fixed base plate; the adjustable pin cylinder has a matched external thread and is screwed into the through hole of the fixed base plate; an extending length of the oblique supporting rod is adjusted through threads; the oblique supporting rod is a steel pipe; an end-blocking steel plate is provided on a bottom of the oblique supporting rod, and a pull ring is provided on a top of the oblique supporting rod; the adjustable pin cylinder has a limit hole, and the oblique supporting rod has two limit holes; before concrete pouring, the limit hole on the top of the oblique supporting rod is aligned with the limit hole of the adjustable pin cylinder, and is locked by the limiting pin shaft to support a formwork; after the concrete pouring, the limiting pin shaft is pulled out; then the limit hole on the bottom of the oblique supporting rod is aligned with the limit hole of the adjustable pin cylinder, and is locked by the limiting pin shaft to form a formwork surface; the cover plate (105) is located on the ring-shaped secondary edge to prevent the formwork from being polluted by concrete during the concrete pouring;

the steel pipe support (7) is arranged on the longitudinal main edge, and is provided between the longitudinal rails (103) and a primary lining (6) for supporting vertical buoyancy;

the turn buckle (8) is arranged between two sides of the formwork and a reserved steel bar for resisting horizontal load generated during asymmetric pouring.

2. A formwork transporting method for full-circle secondary lining inverted arch construction of a long-distance tunnel, comprising adopting a cantilever gantry crane (2) and a transportation flat car (3) for formwork transporting, wherein travel rails of the cantilever gantry crane (2) and the transportation flat car (3) are integrated on a customized steel formwork (1), and there is no other rail; the formwork transporting method comprises specific steps of:

S1: installing the cantilever gantry crane (2) at a hole entrance; hoisting the customized steel formwork (1) by a cantilever part outside the hole, and rotating for 90 degrees;

S2: starting a longitudinally-moving hoist; moving a first formwork to pass through columns of the cantilever gantry crane (2), and transporting to a cantilever part in the hole; then rotating the first formwork by 90 degrees;

S3: lowering the first formwork by the cantilever part in the hole; meanwhile, extending an oblique supporting rod out of the first formwork for supporting, in such a manner that longitudinal rails (103) integrated on the first formwork are aligned with the rails of the cantilever gantry crane (2);

S4: repeating the steps S1-S3, thereby installing a second formwork, and connecting flanges (105) of the first formwork and the second formwork;

S5: repeating the steps S1-S4, thereby installing residual formworks; using the transportation flat car (3) when the formworks are more than a certain amount, so as to improve efficiency;

S6: reinforcing the formworks with steel pipe supports (7) and turn buckles (8), and pouring concrete; withdrawing the oblique supporting rod to a formwork surface as soon as concrete pouring is finished, and then curing;

S7: removing the steel pipe supports (7) and the turn buckles (8), and installing a secondary cantilever gantry crane (2) at the hole entrance;

S8: hoisting the first installed formwork by a cantilever part at the hole entrance, and rotating by 90 degrees; starting the longitudinally-moving hoist, moving the first installed formwork to pass through the columns of the cantilever gantry crane (2), and transporting to a cantilever part at the other end; then rotating the first installed formwork by 90 degrees and placing on the transporting flat car (3);

S9: moving the transportation flat car (3) to the secondary cantilever gantry crane (2), hoisting the first installed formwork by a cantilever part at one end, and rotating by 90 degrees; starting the longitudinally-moving hoist; moving the first installed formwork to pass through the columns of the cantilever gantry crane (2), and transporting to a cantilever part at the other end; lowering the first installed formwork to finish transportation and installation; and S10: repeating the steps S8 and S9; transporting, installing, supporting and reinforcing the residual formworks, and pouring concrete.

* * * * *